US005564530A

United States Patent [19]

Iwakiri et al.

[11] Patent Number: 5,564,530

[45] Date of Patent: Oct. 15, 1996

[54] TRACTION TYPE ELEVATOR

[75] Inventors: Atsushi Iwakiri, Yokohama; Masao Iwasa, Ichikawa, both of Japan

[73] Assignee: Otis Elevator Company, Farmington, Conn.

[21] Appl. No.: 340,512

[22] Filed: Nov. 16, 1994

[30] Foreign Application Priority Data

Feb. 4, 1994 [JP] Japan ..... 6-012322

[51] Int. Cl.[6] ..... B66B 7/08

[52] U.S. Cl. ..... 187/411; 187/345

[58] Field of Search ..... 187/345, 264, 187/343, 414, 411, 266

[56] References Cited

U.S. PATENT DOCUMENTS 2,148,123 2/1939 Hymans ..... 187/411

FOREIGN PATENT DOCUMENTS 1041973 10/1963 France ..... 187/411

200835 1/1966 Sweden ..... 187/266

*Primary Examiner*—Kenneth Noland

*Attorney, Agent, or Firm*—Joseph P. Abate

[57] ABSTRACT

A traction-type elevator includes a driving sheave (19) arranged in an upper portion of an elevator shaft, cage sheaves (6, 7) arranged at an angle with respect to the driving sheave (19) and mounted on a support beam (5), multiple (or turns of a rope) ropes (17) hung on the cage sheaves (6,7) and the driving sheave (19), and a hanging rod (10) for hanging a cage from the support beam (5). In this traction-type elevator according to the invention, one torsion coil spring (16) is arranged between the cage side and the aforementioned support beam (5) appropriately so that the aforementioned hanging rod (10) is inserted through it; the two ends of torsion coil spring (16) are attached to a cage side and a side of the support beam (5), respectively. The support beam (5) can effectively rotate to relax torsion in the ropes (17), and it is possible to suppress generation of vibration by the torsion. Also, the torsion coil spring (16) can play the role in damping vibration without shifting outwardly.

4 Claims, 6 Drawing Sheets

TRACTION TYPE ELEVATOR

CROSS REFERENCE TO RELATED APPLICATION

This application is related to commonly-owned copending application Ser. No. 08/290,199, entitled TRACTION-TYPE ELEVATOR filed, Aug. 15, 1994, by Nammi et al.

BACKGROUND OF THE INVENTION

1. Technical Field

This invention concerns a traction-type elevator in which the cage of the elevator moves vertically under the traction of a rope winding hoister.

2. Description of the Prior Art

FIGS. 4–6 show a conventional traction-type elevator. As shown in the FIGS. 4 and 5, a cage (101) is movable vertically in an elevator shaft (102). A pair of cage sheaves (104, 105) is mounted via a cage frame (103) on the upper portion of the cage (101). That is, the cage sheaves (104, 105) are arranged in a support beam (107); see FIG. 5. In the support beam (107), a hanging rod (108) is arranged. The hanging rod (108) is mounted on the cage frame (103) via spring washers (113) and multiple torsion coil springs (114). Each of the multiple torsion coil springs (114) is contained in upper/lower cases (or housings) (115*a*, 115*b*) so that each torsion coil spring (114) does not escape from between the spring washers (113) and the cage frame (103).

Multiple turns of a rope (106) are hung on the cage sheaves (104, 105). The rope (106) is also hung on a driving sheave (110) of a hoister (109) which includes, e.g., a motor. One end of the rope (106) is attached to an overhead beam (111), and the other end is attached to a counterweight (112); see FIG. 4.

The diameters of the sheaves (104, 105) are determined from the legally determined diameter of the rope (106). Consequently, when the sheaves (104, 105) become larger, as shown in FIG. 6, it becomes impossible to arrange said sheaves (104, 105) along the cage frame (103). Instead, the sheaves (104, 105) are arranged at an angle with respect to frame (103); that is, in the diagonal direction of the cage (101). On the angled sheaves (104, 105), multiple turns of the rope (106) are wound; they are also wound on the driving sheave (110) above the sheave (104).

Because the sheaves (104, 105) are arranged in the diagonal direction of the cage (101), there is a small twist for the overall rope (106) wound on the driving sheave (110) from the cage sheave (104). In particular, when the cage (101) moves to the upper floors, the twist of the rope (106) is increased.

As the rope (106) is pulled by the driving sheave (110) to move the cage vertically, a vibration is generated by the twist of the rope (106).

In addition, when an end (106*a*, FIG. 4) of the rope (106) attached to the overhead beam (111) deviates slightly with respect to the cage sheave (104), the vibration becomes larger. However, transmission of the vibration generated to the cage (101) can be prevented by using multiple torsion coil springs (114) arranged between the support beam (107) and the cage frame (103).

As explained above, for the conventional traction-type elevator, when the cage (101) moves to the upper floors, the twist of the rope (106) is increased, the support beam (107) rotates slightly, and the support beam (107) deviates slightly with respect to the cage frame (103). Consequently, the upper case (115*a*) and the lower case (115*b*) are pressed against each other, and the vibration-proof effect of the torsion coil springs (114) is hampered.

As the twist of rope (106) is increased, in order to reduce the twist, the support beam (107) is rotated slightly with respect to the cage frame (103).

However, if the support beam (107) can be rotated somewhat to alleviate the aforementioned twist, the vibration generated can be suppressed somewhat. However, as pointed out above, the support beam (107) cannot be rotated significantly because of the presence of the cases (115*a*, 115*b*); thus, the vibration generated cannot be suppressed at all.

SUMMARY OF THE INVENTION

A principal object of the present invention is to provide a type of traction-type elevator wherein the vibration-proof effect of the torsion coil spring(s) can be sufficiently displayed or realized, and the support beam can be rotated effectively.

According to the present invention, a traction-type elevator is equipped with or includes: a driving sheave arranged in the upper portion of an elevator shaft, a cage sheave arranged at an angle with respect to the driving sheave and in a support beam, multiple turns of a rope hung on the cage sheave and the driving sheave, and a hanging rod for hanging the cage in the support beam; a (preferably one) torsion coil spring arranged between the cage side and the support beam and inserted around the hanging rod, and the two ends of the torsion coil spring being engaged with the cage side and the support beam side, respectively.

When the hoister is turned on and the cage is pulled from the lowest floor to the highest floor, the twist of the rope is increased as the cage approaches the upper floor. As the twist of the rope is increased, the support beam is rotated in a direction which reduces the twist. Consequently, the vibration generated by the twist of the rope can be somewhat suppressed.

As the cage moves vertically, because the torsion coil spring is inserted or disposed around the hanging rod, the spring can display or realize the vibration-proof effect without escaping from its mounting arrangement.

Further and still other objects of the present invention will become more readily apparent when the following detailed description is taken in conjunction with the accompanying drawing, in which:

DETAILED DESCRIPTION OF THE PREFERRED EMBODIMENTS AND BEST MODE

Figure 1:
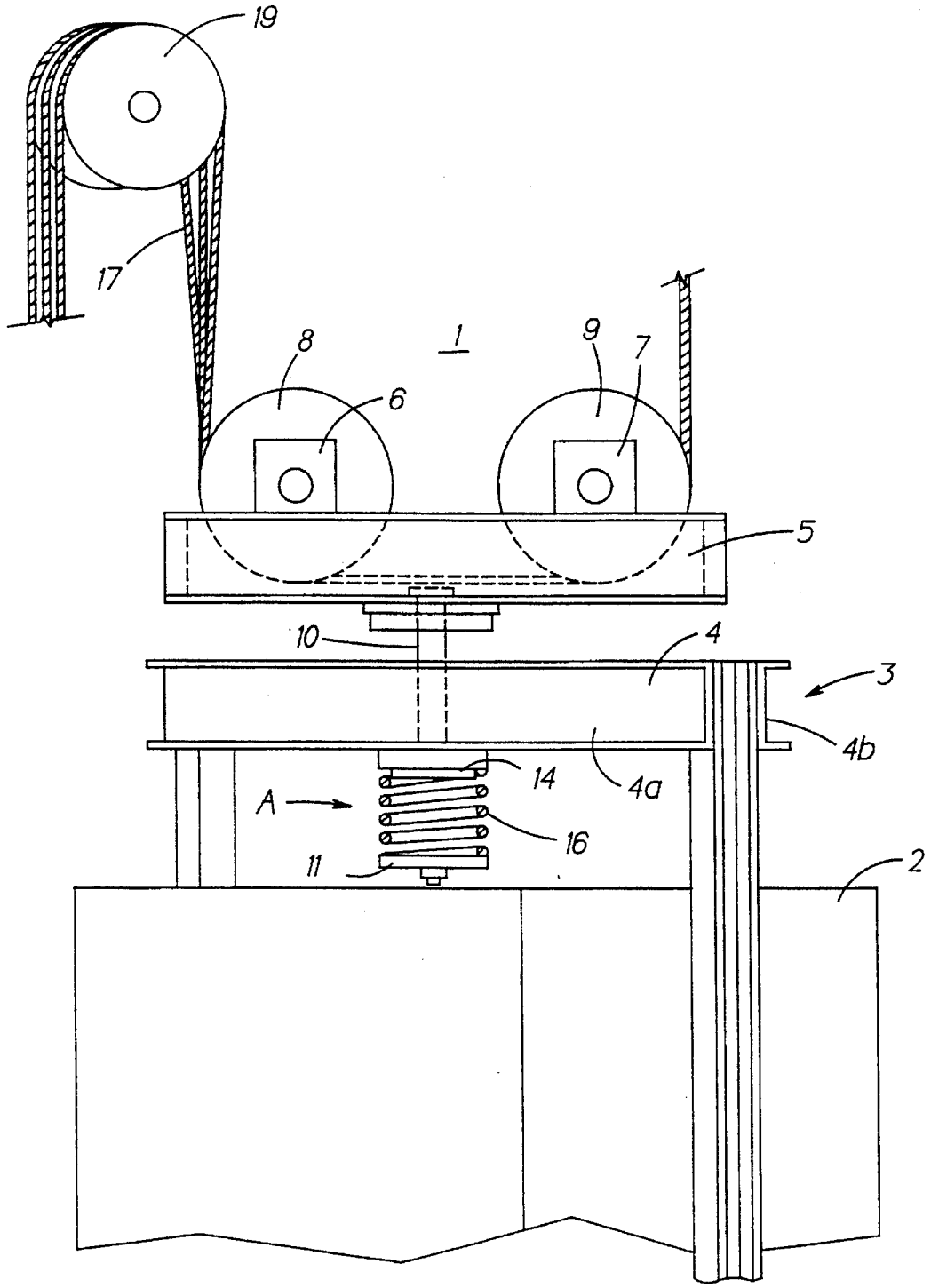
FIG. 1 is side schematic view illustrating an application example of the traction-type elevator of the present invention.
Figure 2:
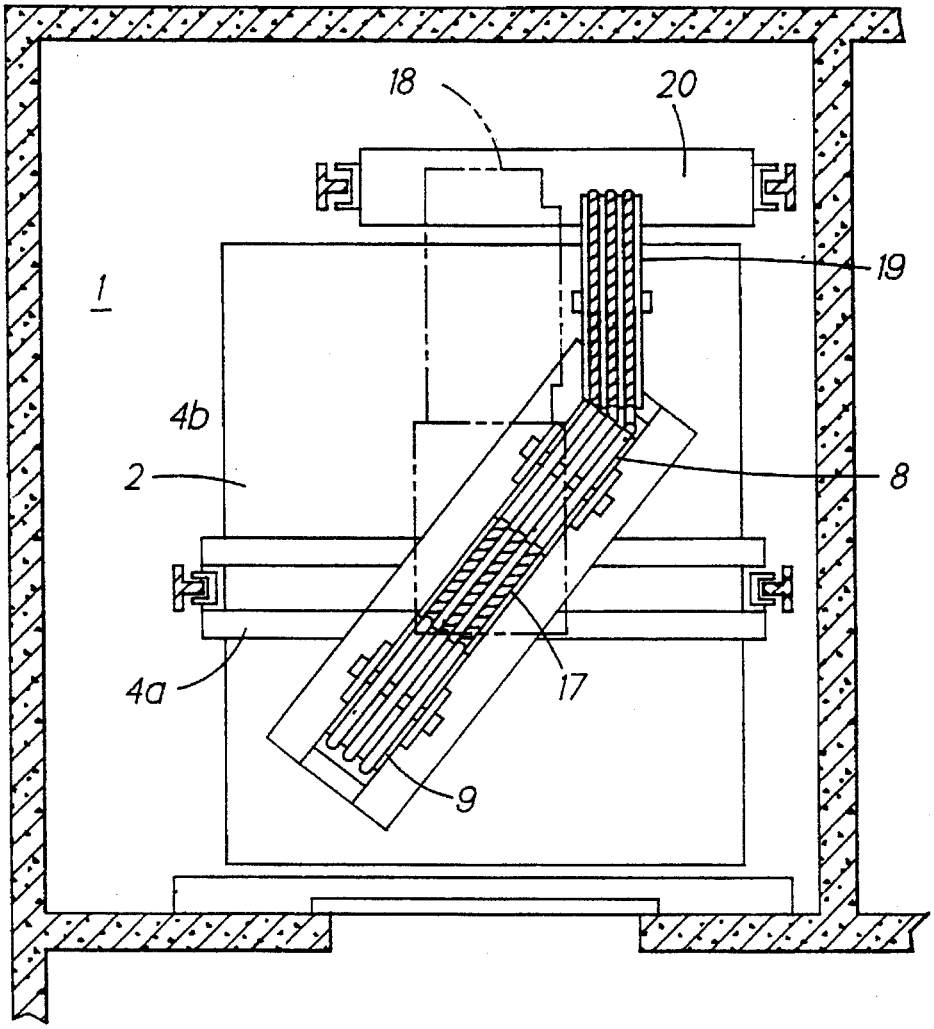
FIG. 2 is a top view of the traction-type elevator of FIG. 1.
Figure 3:
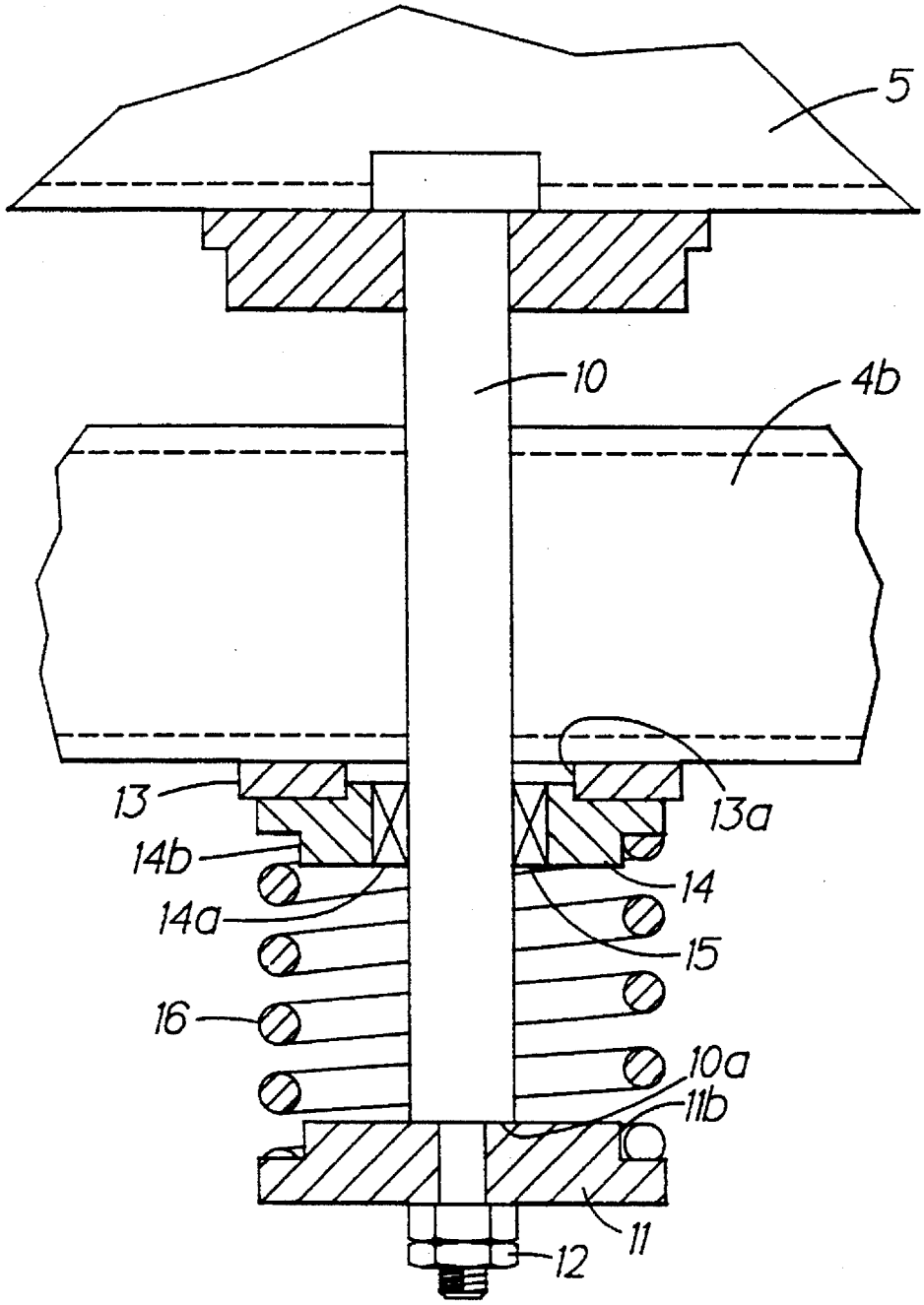
FIG. 3 is an enlarged cross-sectional view of the area indicated by an arrow A of FIG. 1.
Figure 4:
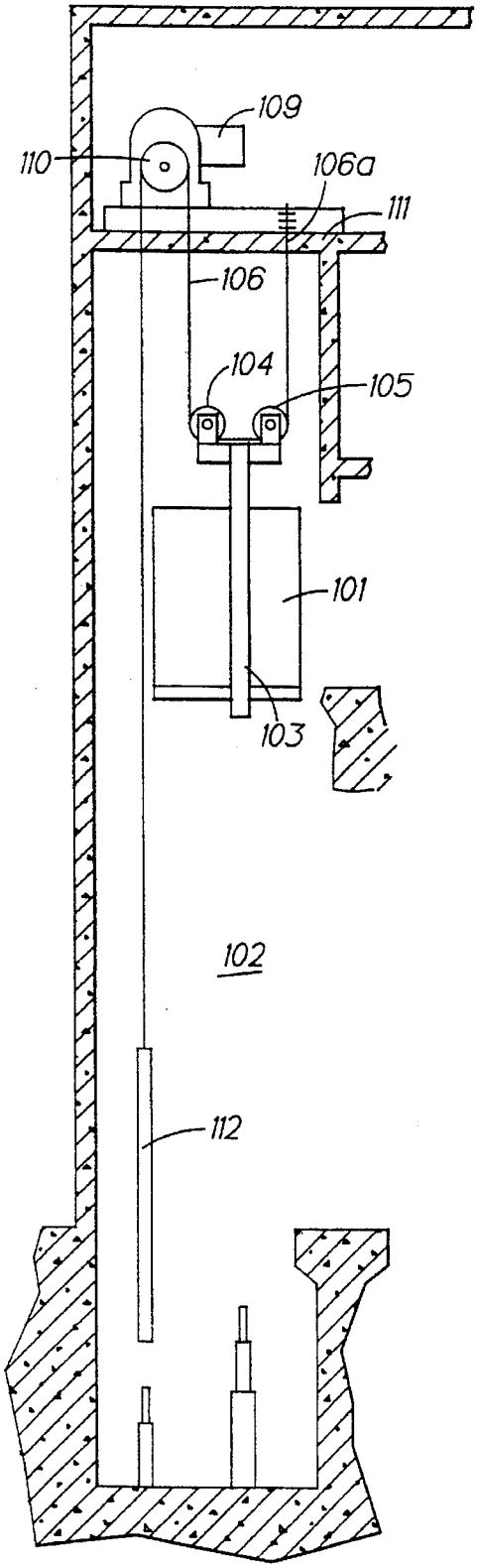
FIG. 4 PRIOR ART
FIG. 4 is a schematic cross-sectional view of a conventional traction-type elevator.
Figure 5:
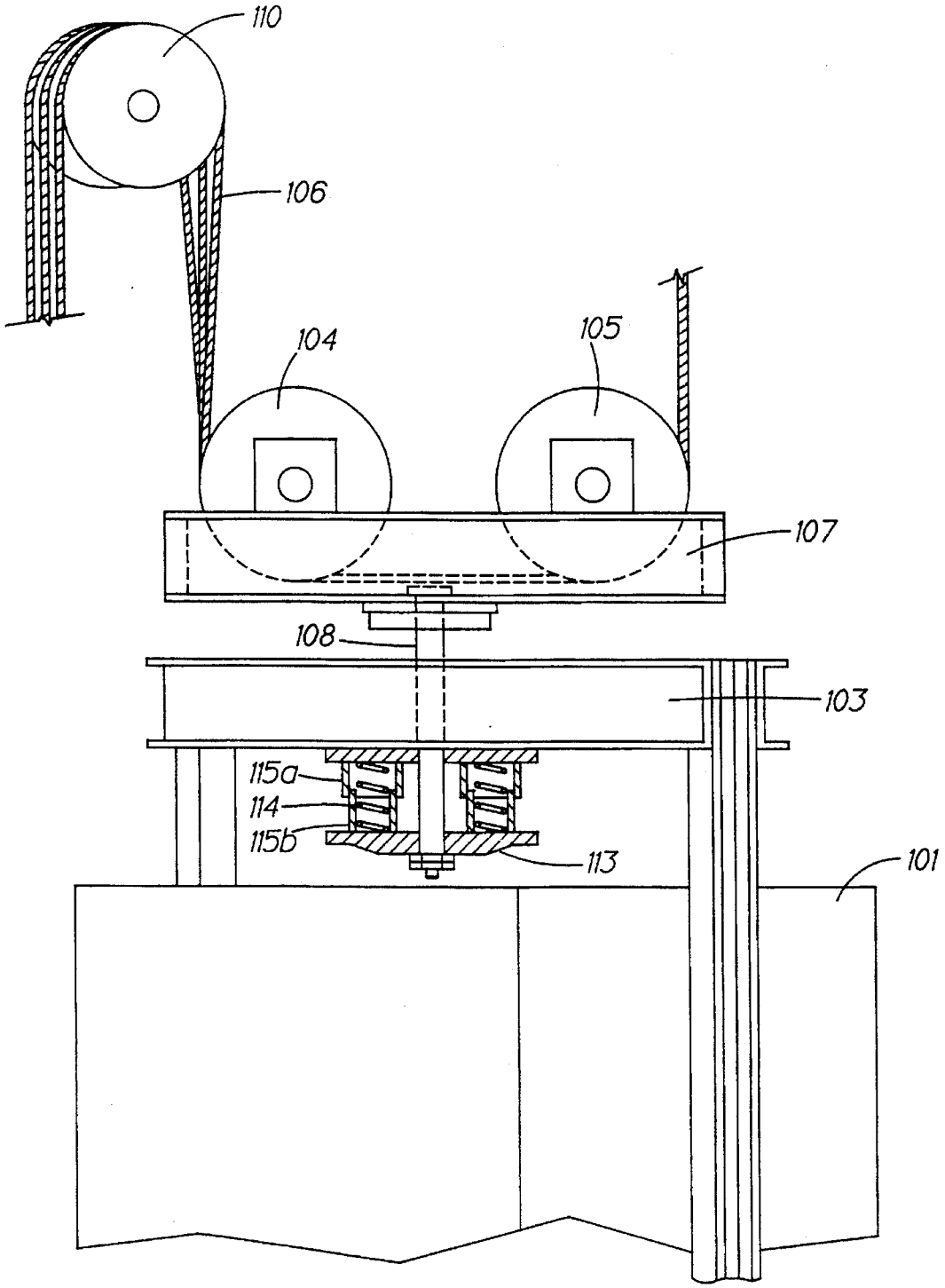
FIG. 5 PRIOR ART
FIG. 5 is a side schematic view of the aforementioned conventional traction-type elevator.
Figure 6:
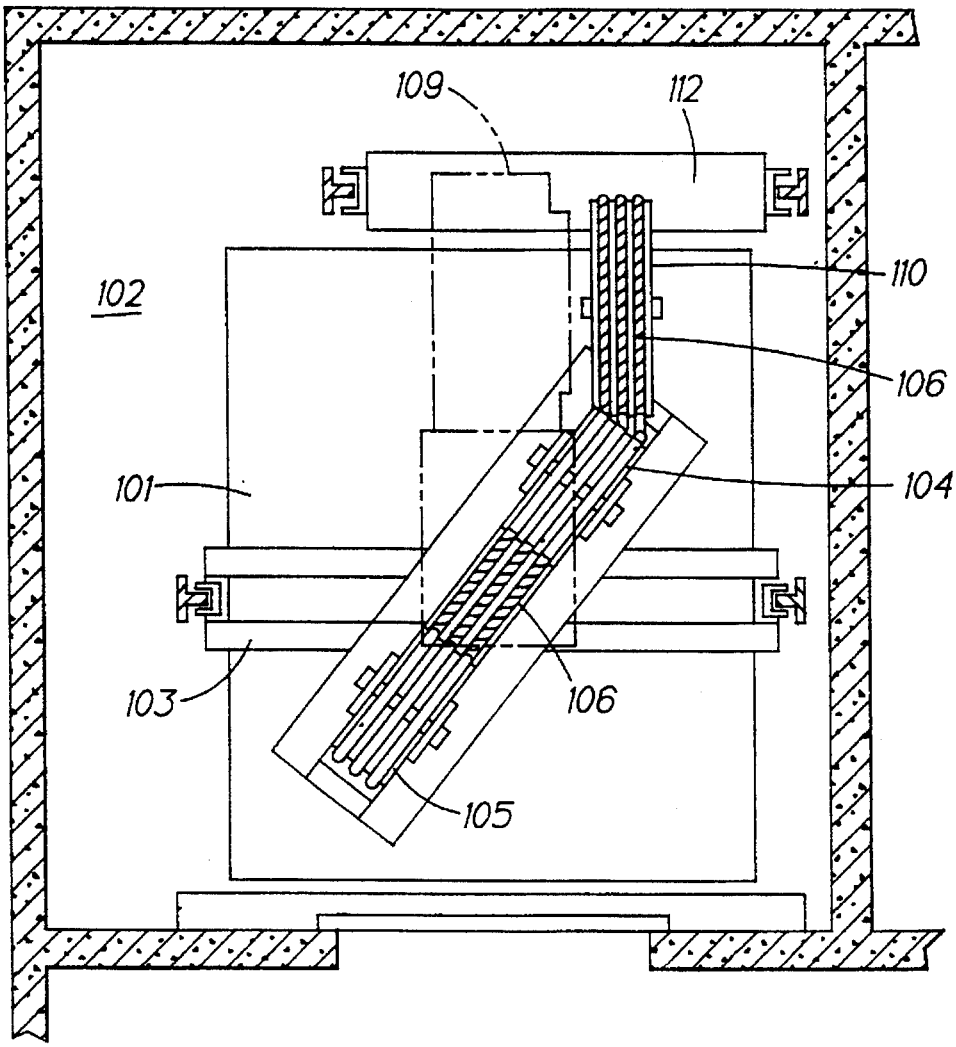
FIG. 6 (PRIOR ART)
FIG. 6 is a top view of the aforementioned conventional traction-type elevator.

The present invention will be explained in more detail with reference to application examples illustrated by the FIGS. 1–3. FIGS. 1–3 are diagrams illustrating an application example of the traction-type elevator of the present invention.

In FIGS. 1 and 2, a cage (2) is arranged in a vertically movable manner in an elevator shaft (1). On the cage (2), a cage frame (3) is arranged. A support beam (5) is arranged above a crossbeam (4) of the cage frame (3). In the support beam (5), a pair of cage sheaves (8, 9) is mounted in a rotatable manner through support pieces (6, 7), respectively.

As shown more clearly in FIG. 3, a hanging rod (10) extends downwardly from (and, e.g., is fixed to) the support beam (5). The hanging rod (10) extends downwardly between a pair of C-shaped steel parts (4*a*, 4*b*) which form the crossbeam (4). A step portion (10*a*) is formed on a tip side of the hanging rod (10). On the step portion (10*a*), a circular plate-shaped lower spring washer (11) is fixed by, e.g., fastening a double nut (12).

A support plate (13), through which the hanging rod (10) is inserted in an insertion hole (13*a*), is fixed on the lower end surface of the C-shaped steel parts (4*a*, 4*b*). A circular plate-shaped upper spring washer (14) is pressed into the insertion hole (13*a*) so that a portion of the spring washer 14 is, in effect, fixed to the support plate 13. A mounting hole (14*a*) is formed on the upper spring washer (14). A bearing (15) soaked with any suitable lubricant is fitted in the mounting hole (14*a*), and the hanging rod (10) is supported in a freely rotatable manner.

Step portions (14*b*, 11*b*) are formed on the surfaces of the upper spring washer (14) and the lower spring washer (11) facing each other. The two ends of a torsion coil spring (16) having a shape [sic; size] larger than that of a conventional torsion coil spring (that is, with a higher rigidity than that of a conventional torsion coil spring) are pressed into the step portions (14*b*, 11*b*), respectively. In this way, the two ends of torsion coil spring (16) are fixed (engaged) on the upper and lower spring washers (14, 11), respectively. Also, the torsion coil spring (16) is inserted over the hanging rod (10) when the spring is installed on the spring washers (14, 11). Consequently, even without the case utilized in the conventional method, the torsion coil spring still does not escape from the upper and lower spring washers (14, 11).

Because of reasons previously discussed, the cage sheaves (8, 9) have a relatively large diameter. Consequently, the cage sheaves (8, 9) are arranged in the diagonal direction of the cage (2) (i.e., the oblique direction shown in FIG. 2).

Multiple turns of a rope (17) are hung on the cage sheaves (8, 9). The rope (17) is hung on the driving sheave (19) of the hoister (18) arranged in the machine chamber or machine room. One end of the rope (17) is fixed on the overhead beam (not shown in the figure) in the upper portion of the elevator shaft. The other end of the rope is fixed on a counterweight (20) arranged for balancing the cage (2). In this case, the hoister (18) is arranged in the perpendicular direction to the crossbeam (4) (the left-right direction in FIG. 2) in the machine chamber. Consequently, the driving sheave (19) is arranged at an angle with respect to the cage sheaves (8, 9).

As the rope (17) is pulled by the hoister (18), the cage (2) is moved from the lowest floor to the highest floor. As the rope (17) pulls the cage (2) near the upper floor, the twist in the rope 17 is increased. The support beam (5) is mounted on the crossbeam (4) (cage frame (3)) through one torsion coil spring (16). As the rope (17) is twisted, the support beam (5) in an initial position (together with the rod 10) rotates in a direction which reduces the twist. Consequently, as the cage (2) approaches the upper floor and the twist of rope (17) is increased, the support beam (5) is rotated in the direction which reduces the twist. Thus, the vibration caused by the twist of the rope (17) is somewhat suppressed.

When the cage (2) moves from the uppermost floor to the lowest floor, the twist of the rope (17) disappears, and the support beam (5) is reset to the initial position by means of the spring bias from the torsion coil spring (16).

When the cage (2) moves vertically, because the torsion coil spring (16) is inserted onto the hanging rod (10), the torsion coil spring does not escape from the upper and lower spring washers (14, 11); thus, its vibration-proof function can still be displayed or realized.

As explained above, according to the present invention, one torsion coil spring is inserted onto or around a hanging rod when, e.g., the rod is installed between the cage side and the support beam. The two ends of the torsion coil spring are fixed on the cage side (by means of washer 14 and plate 13 which is fixed to the beam 4) and on the support beam side (by means of washer 11, nut 12, and rod 10 which is fixed to the beam 5), respectively. Consequently, the support beam can rotate effectively to alleviate the twist of the rope, so that the vibration caused by the twist can be somewhat suppressed. Also, the torsion coil spring does not escape and it can display the vibration-proof or damping function.

While there has been shown and described what is at present considered preferred embodiments of the present invention, it will be apparent to those skilled in the art that various changes and modifications may be made therein without departing from the spirit and scope of the present invention which shall be limited only by the appended claims.

What is claimed is:

1. A traction-type elevator, comprising:

a driving sheave (19) arranged in an upper portion of an elevator shaft (1), cage sheaves (8,9) arranged at an angle with respect to said driving sheave (19) and mounted on a support beam (5); at least one rope (17) hung on said cage sheave (8,9) and said driving sheave (19); a cage 2; a cage frame attached to said cage; a hanging rod 10 for hanging said cage (2) from said support beam (5), said hanging rod (10) being fixed to said support beam and being rotatably mounted through said cage frame (3); a support plate (13) fixed to said cage frame (3), said support plate having an insertion hole (13*a*), a spring washer (14) having a portion disposed within the insertion hole, said spring washer having a mounting hole (14*a*) aligned with the insertion hole, and a bearing (15) disposed within the mounting hole and engaged with said hanging rod; a torsion coil spring (16) surrounding a portion of said hanging rod, said torsion coil spring having one end attached to and torsionally biased against said cage frame and having another end attached to and torsionally biased against said hanging rod, so that said torsion coil spring torsionally biases said support beam.

2. An elevator as claimed in claim 1, further comprising a lubricant disposed on said bearing.

3. An elevator as claimed in claim 1, wherein said cage frame includes a plurality of C-shaped metal parts through which said hanging rod is rotatably mounted.

4. An elevator as claimed in claim 3, wherein said metal is a steel.

* * * * *